US007308901B2

(12) United States Patent
Meyer

(10) Patent No.: US 7,308,901 B2
(45) Date of Patent: Dec. 18, 2007

(54) CANOPY COVER HAVING A MESHED PORTION

(75) Inventor: Ted H. Meyer, Long Beach, CA (US)

(73) Assignee: Caravan Canopy International, Inc., La Mirada, CA (US)

( * ) Notice: Subject to any disclaimer, the term of this patent is extended or adjusted under 35 U.S.C. 154(b) by 145 days.

(21) Appl. No.: 11/075,486

(22) Filed: Mar. 9, 2005

(65) Prior Publication Data

US 2005/0211287 A1 Sep. 29, 2005

Related U.S. Application Data

(60) Provisional application No. 60/556,320, filed on Mar. 24, 2004.

(51) Int. Cl.
*E04H 15/16* (2006.01)

(52) U.S. Cl. ..... 135/158; 135/117; 135/94; 135/115; 52/82

(58) Field of Classification Search ..... 135/93–94, 135/96, 131, 135, 145, 147, 158–159, 115, 135/913, 117; 52/82–83, 63, 198, 98; 5/97, 5/99.1

See application file for complete search history.

(56) References Cited

U.S. PATENT DOCUMENTS 312,446 A * 2/1885 Drake ..... 135/25.3
789,982 A 5/1905 Lockett
3,896,830 A * 7/1975 Sharick ..... 135/93
4,269,210 A 5/1981 Marks
5,261,435 A 11/1993 Stanley et al.
5,275,188 A * 1/1994 Tsai ..... 135/97
D366,511 S * 1/1996 Coddington, Jr. ..... D21/834
5,485,863 A * 1/1996 Carter ..... 135/145
5,490,532 A * 2/1996 Mallookis et al. ..... 135/117
D370,149 S * 5/1996 Stratton ..... D6/610
5,555,680 A 9/1996 Sweers
5,573,026 A 11/1996 Griffith
5,664,595 A * 9/1997 Vonderhorst et al. ..... 135/16
5,678,586 A * 10/1997 Baksh ..... 135/33.7
D409,762 S 5/1999 Blessing
6,009,891 A * 1/2000 Surface et al. ..... 135/98
6,167,898 B1 * 1/2001 Larga et al. ..... 135/137
6,283,136 B1 * 9/2001 Chen ..... 135/144

(Continued)

FOREIGN PATENT DOCUMENTS

GB 2400386 * 10/2004

(Continued)

OTHER PUBLICATIONS

International Search Report; dated Nov. 13, 2006; for International Application No. PCT/US05/09549; in the name of Caravan Canopy Intl., Inc.

*Primary Examiner*—Winnie Yip
(74) *Attorney, Agent, or Firm*—Christie, Parker & Hale, LLP

(57) ABSTRACT

A canopy system including a canopy frame and a canopy cover supported by the canopy frame. The canopy cover includes an inner solid portion, an outer solid portion, and a meshed portion disposed between the inner and outer solid portions and disposed proximately to an outer periphery of the canopy cover.

19 Claims, 9 Drawing Sheets

U.S. PATENT DOCUMENTS 6,349,506 B1 2/2002 Pace et al.
6,467,107 B1 10/2002 Glover et al.
D482,130 S * 11/2003 Wu ..... D25/56
6,718,565 B1 4/2004 Cruz
6,718,656 B2 * 4/2004 Houser et al. ..... 36/88
6,745,521 B1 * 6/2004 Klemming ..... 52/79.6
6,761,181 B1 * 7/2004 Tseng ..... 135/133
2003/0159748 A1 * 8/2003 Tung ..... 139/117

FOREIGN PATENT DOCUMENTS

WO WO 03058010 A1 * 7/2003

* cited by examiner

CANOPY COVER HAVING A MESHED PORTION

CROSS-REFERENCE TO RELATED APPLICATION

This application claims priority to and the benefit of, under 35 U.S.C. § 119(e), U.S. Provisional Application Ser. No. 60/556,320, filed on Mar. 24, 2004, which is incorporated herein by reference.

FIELD OF THE INVENTION

The present invention relates generally to a canopy having a canopy cover with a meshed portion disposed therein, and more particularly to a canopy having a canopy cover with a meshed portion disposed proximately to an outer periphery of the canopy cover.

BACKGROUND

A canopy typically includes a canopy cover supported on an underside thereof by a metal frame (e.g., aluminum or steel.) Canopy covers are typically composed of a fabric material such as polyester or polyethylene. The canopy cover hangs over the canopy frame to provide shelter from exterior elements such as the sun, rain or other weather conditions or debris.

However, canopy covers are typically constructed from a uniformly solid material, that does not include holes or openings extending therethrough. As such, when it rains on the cover, pools of rain water often gather on various portions of the cover. These pools often cause the cover to sag forming an unsightly or lumpy overall appearance for the cover. These pools of rain water also exert undesirable forces against the canopy cover which may tear or otherwise damage the cover. Accordingly, a need exists for a canopy cover that allows for draining of rain water from the canopy cover during raining.

SUMMARY OF THE INVENTION

In an exemplary embodiment of the present invention a canopy system is provided that includes a canopy frame and a canopy cover supported by the canopy frame. The canopy cover includes an inner solid portion, an outer solid portion, and a meshed portion disposed between the inner and outer solid portions and disposed proximately to an outer periphery of the canopy cover.

In another exemplary embodiment of the present invention, the inner and outer solid portions of canopy system as described above substantially prevent, and the meshed portion permits, a passage of a fluid therethrough; a majority of the canopy cover is defined by the inner solid portion, with the meshed portion and the outer solid portion each defining relatively small outer strips of the canopy cover; and the meshed portion encircles an outer periphery of the inner solid portion, and the outer solid portion encircles an outer periphery of the meshed portion

BRIEF DESCRIPTION OF THE DRAWINGS

The exemplary embodiments of the present invention will be better understood by reference to the following detailed description when considered in conjunction with the accompanying drawings wherein.

DETAILED DESCRIPTION OF THE DRAWINGS

Figures 1, 2:
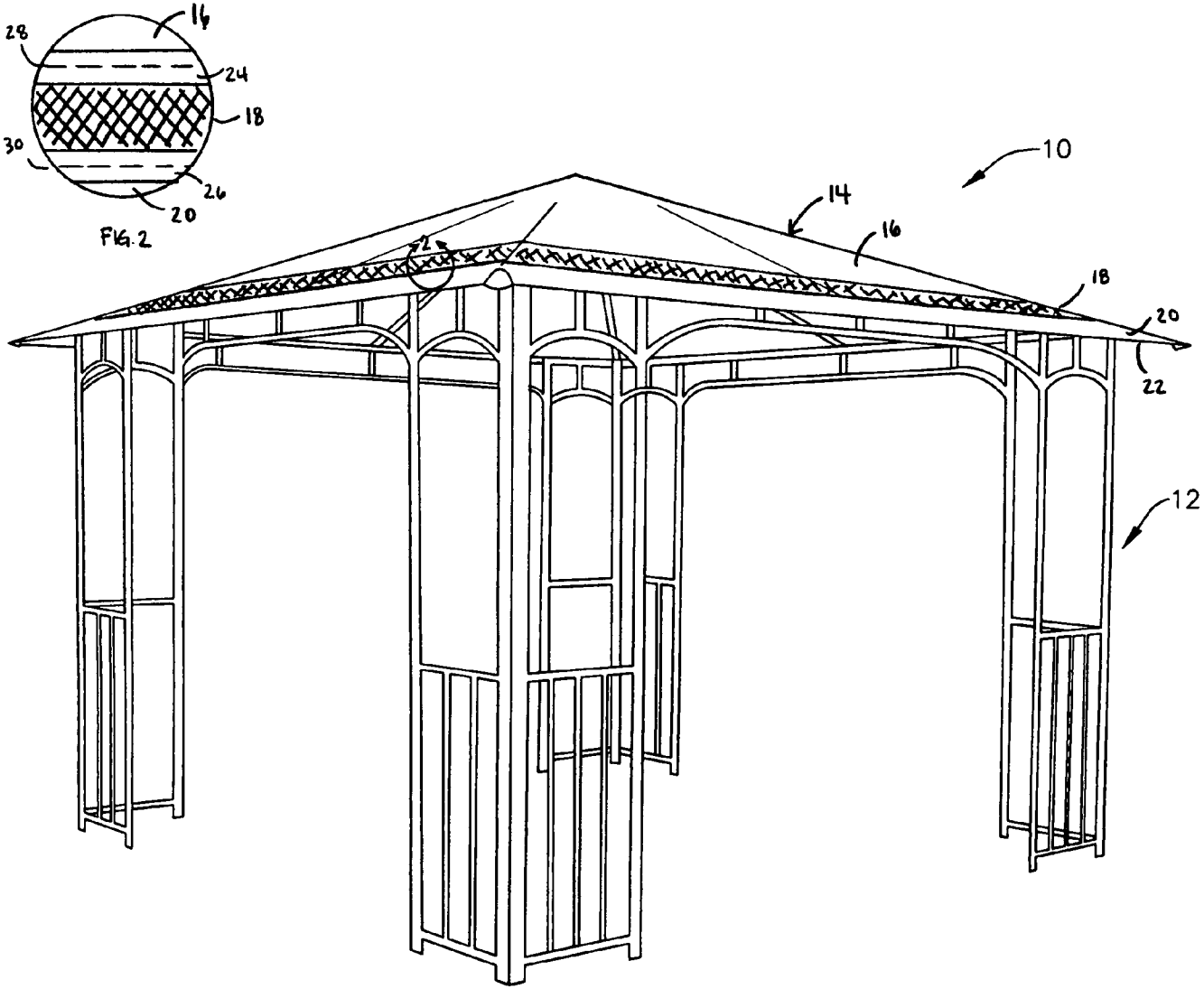
FIG. 1 is a perspective view of a canopy system according to one exemplary embodiment of the present invention having an inner solid portion, and outer solid portion and a meshed portion extending therebetween.
FIG. 2 is an enlarged detail of the connection of the meshed portion to each of the inner and outer solid portions.

As shown in FIGS. 1-10, exemplary embodiments of the present invention are directed to a canopy having a canopy cover with a meshed portion disposed proximately to an outer periphery of the canopy cover. For example, FIG. 1 shows a canopy 10 according to one embodiment of the invention. As shown, the canopy 10 includes a canopy cover 14 which is supported by a canopy frame 12. The canopy cover 14 includes an inner solid portion 16, an outer solid portion 20 forming the outer periphery of the canopy cover 14, and a meshed portion 18 disposed between the inner solid portion 16 and the outer solid portion 20. The meshed portion 18 allows a fluid, such as rain water, to pass therethrough, such that the fluid does not collect on the inner solid portion 16 of the canopy cover 14.

The inner and outer solid portions 16 and 20 may be made of any suitable fabric material such as polyester, polyethylene, or any other suitable material. Similarly, the meshed portion 18 may be made of any suitable meshed material, which may include one or more of, but not limited to polyester, polyethylene, plastic or nylon. The meshed portion 18 may have a single layer of meshed material, or may have two or more layers of meshed material that are overlaid one on top of the other.

As shown in FIG. 1, the inner solid portion 16 extends toward a center of the canopy cover 14. At an end of the inner solid portion 16 opposite from the center of the canopy cover 14, the meshed portion 18 encircles or surrounds an outer periphery of the inner solid portion 16. Similarly, the outer solid portion 20 encircles or surrounds an outer periphery of the meshed portion 18. An outer periphery of the outer solid portion 20 forms an outer periphery 22 of the canopy cover 14.

As shown in FIG. 2, in one embodiment, the meshed portion 18 includes first and second solid ends 24 and 26. In this embodiment, the first end 24 of the meshed portion 18 is attached to the inner solid portion 16 by a thread, forming a first seam 28; and the second end 26 of the meshed portion 18 is attached to the outer solid portion 20 by a thread, forming a second seam 30. However, in other embodiments the meshed portion 18 may be attached between the inner and outer solid portions of the canopy cover 14 by any suitable device and/or method.

When a fluid falls against an upper surface of the canopy cover 14, such as when it is raining, the fluid is allowed to drain through the meshed portion 18, such that an accumulation of the fluid on the upper surface of the canopy cover 14 is reduced or eliminated. As such, the formation of unsightly and potentially harmful pools on the upper surface of the canopy cover 14 is reduced or eliminated.

In one embodiment, the meshed portion 18 includes a screen-like material which may be formed by metal wires such as steel wires, aluminum wires, plastic-coated wires, or a plastic or fibrous mesh, or a fiberglass mesh. Alternatively, the meshed portion 18 may include any porous material which permits a largely unimpeded passage of rain water through the material while preferably also preventing the entry of relatively large debris.

In one embodiment, as shown in FIG. 1, the relatively small strip of the outer solid portion 20 allows the meshed portion 18 to be disposed in close proximity to the outer periphery 22 of the canopy cover 14. Thus fluid, such as rain water, is allowed to drain through the meshed portion 18 of the canopy cover 14, while a majority of the canopy cover 14 (i.e., that defined by the inner solid portion 16) functions to shelter persons disposed underneath the canopy cover 14 from the fluid. This produces a canopy cover 14 having a large area of sheltering capacity, while also reducing or eliminating the collection of fluids on the upper surface of the canopy cover 14.

Figure 3:
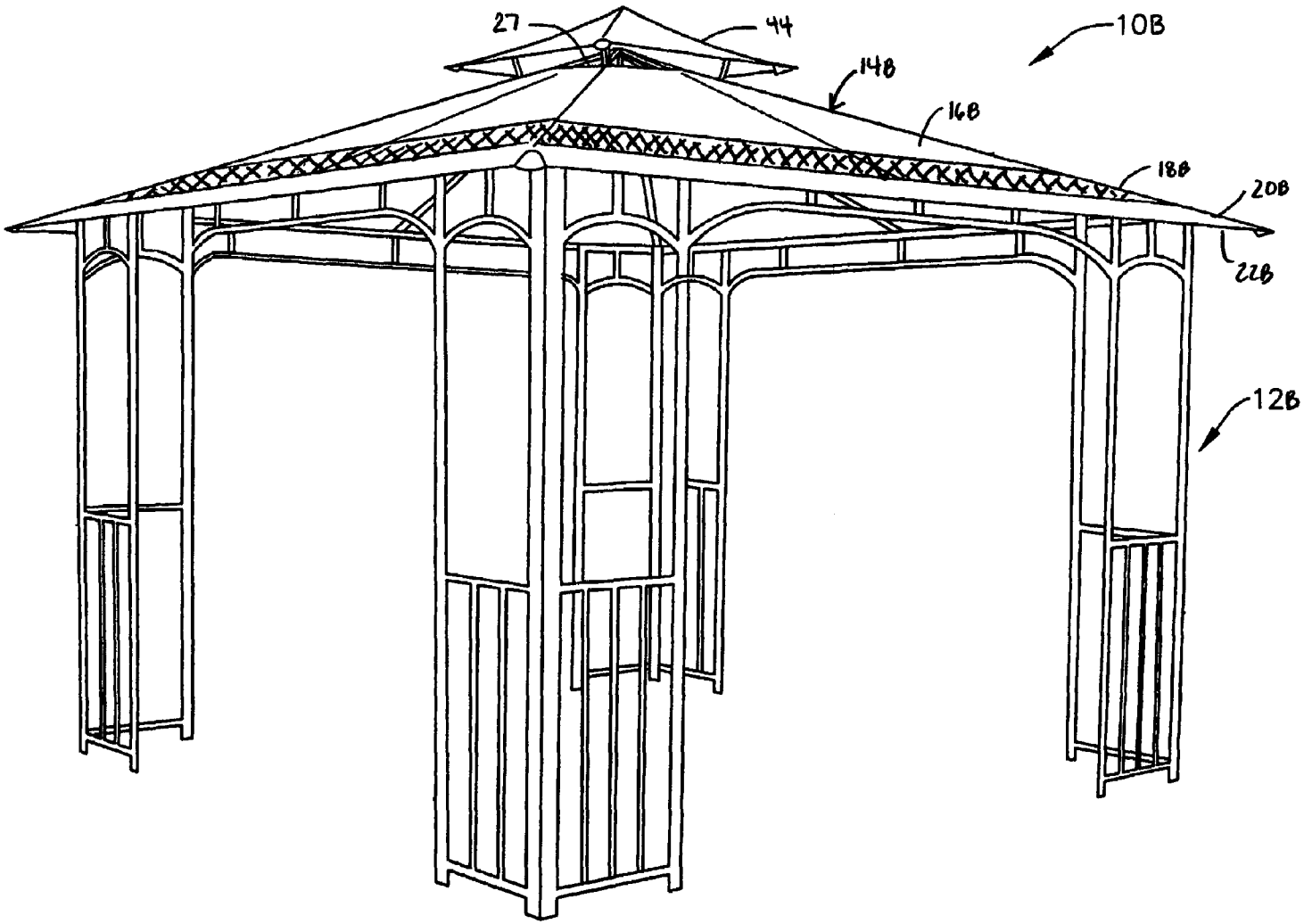
FIG. 3 is a perspective view of a two-tier canopy system according to another exemplary embodiment of the present invention.

In the embodiment of FIG. 3, a canopy cover 14B having an inner solid portion 16B, an outer solid portion 20B and a meshed portion 18B extending therebetween, as described above, is incorporated into a two-tier canopy system 10B. In one embodiment, the meshed portion 18B is disposed in close proximity to an outer periphery 22B of the canopy cover 14B, as is also described above. The two-tier canopy system 10B includes a canopy frame 12B which supports both the canopy cover 14B and a second canopy cover 44.

Figure 4:
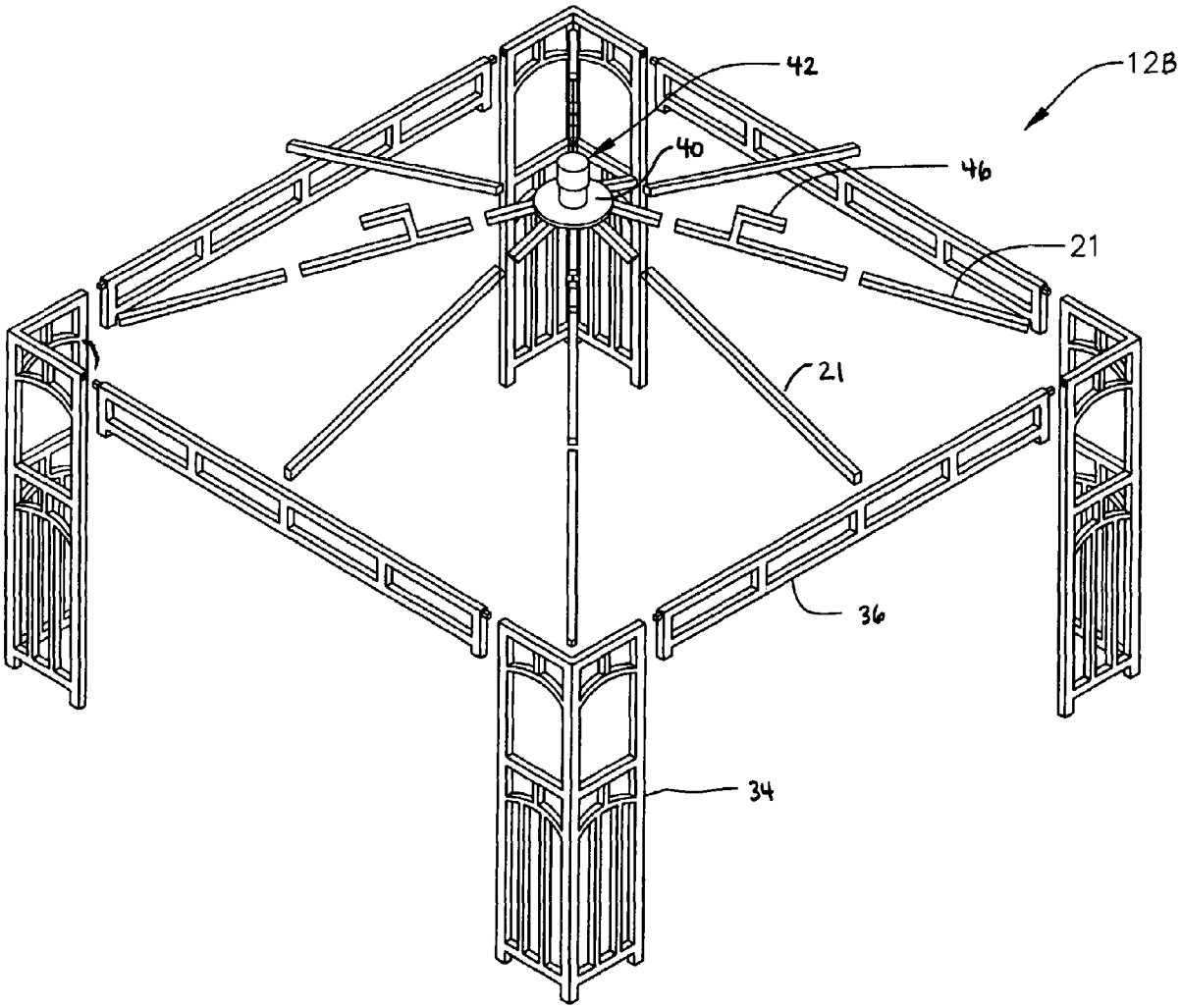
FIG. 4 is an exploded perspective view of one exemplary embodiment of a canopy frame for use in the two tier canopy system of FIG. 3.

FIG. 4 shows an exemplary embodiment of a canopy frame 12B' for use with the two-tier canopy system 10B of FIG. 3. However, it is noted that those skilled in the art would recognize that the canopy cover 14B can be used together with any suitable two-tier canopy frame. As shown in FIG. 4, the canopy frame 12B' includes a plurality of vertically extending legs 34 that are laterally supported by corresponding support members 36 (note that the components of FIG. 4 are shown in an exploded view for clarity.) The legs 34 are attached to the support members 36 by any one of a variety of fastening methods, such as welding and/or any other suitable fastening device/method.

As is also shown, the canopy frame 12B' includes a plurality of arms 21. Each arm 21 is connected at or near a center of the frame 12B' to a connecting plate 40 (see also FIG. 7), and extends to an outer periphery of the frame 12B' to connect to either a corresponding one of the legs 34 or a corresponding one of the support members 36. In the exemplary embodiment of FIG. 4, the arms 21 are approximately equally spaced and radially extend in a substantially conical configuration. However, in other embodiments the arms 21 may form other configurations.

Figure 5:
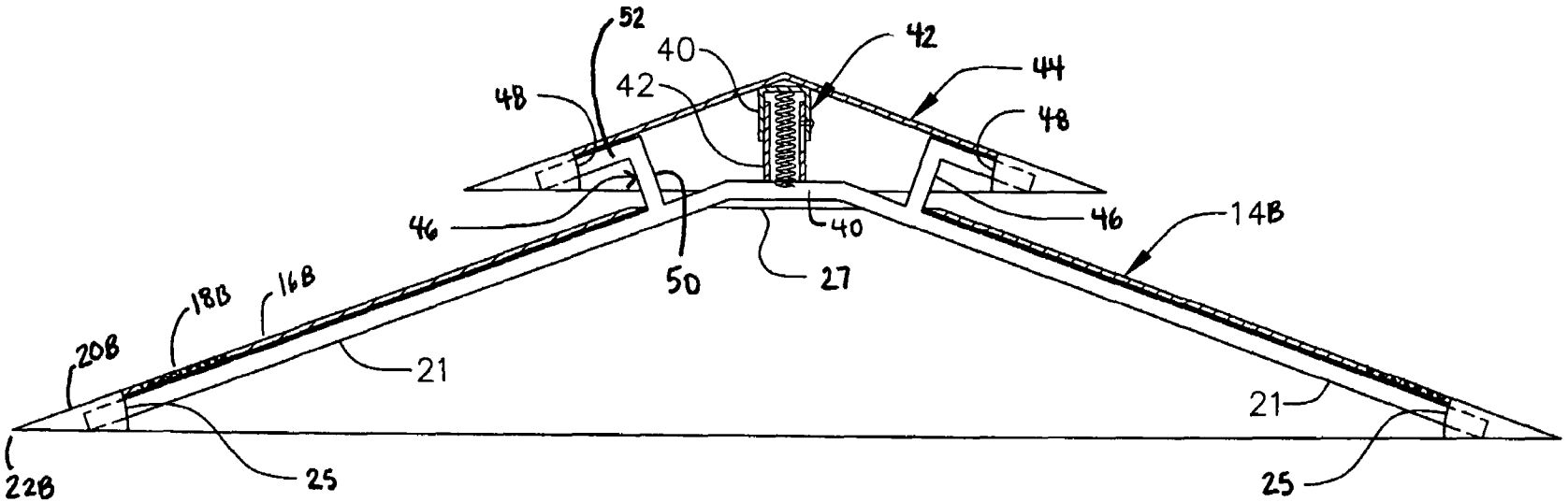
FIG. 5 is a side cross-sectional view of the two tier canopy system of FIG. 3.

As shown, for example in FIG. 5, the canopy cover 14B is disposed directly above and is supported by the arms 21. The canopy cover 14B also includes a plurality of sleeves 25, which each form a pocket which receives a peripheral end of a corresponding one of the arms 21. In one embodiment, the canopy frame 12B' includes eight arms 21 and the canopy cover 14B includes four sleeves 25, such that every other arm 21 is attached to a corresponding one of the sleeve 25.

As shown for example in FIG. 5, the canopy cover 14B, also referred to as the first canopy cover 14B, has a central opening 27 (see also FIG. 3.) The central opening 27 allows for a central post 42, which is attached to the connecting plate 40 of the canopy frame 12B', to extend through the central opening 27 to support the second canopy cover 44. In such a configuration, at least a portion of the second canopy cover 44 is disposed above the central opening 27 of the first canopy cover 14B.

Figure 6:
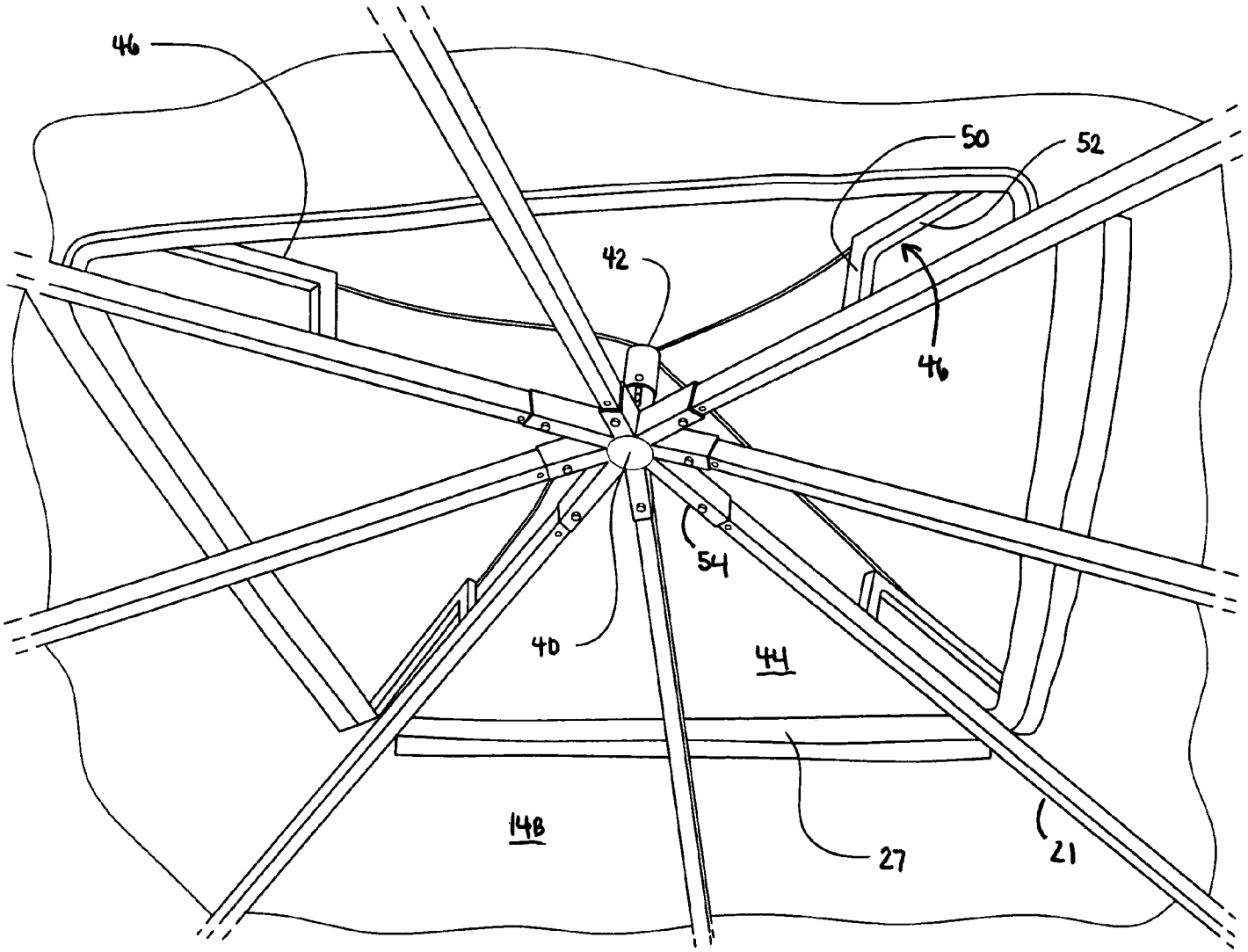
FIG. 6 is a bottom perspective view of the canopy frame of FIG. 4 being used to support first and second coverings of the two tier canopy system of FIG. 3.

As shown in FIG. 5, corresponding ones of the arms 21 have hooks 46 (see also FIG. 4) that extend through the central opening 27 of the first canopy cover 14B and attach to the second canopy cover 44. As shown in FIGS. 5 and 6, each hook 46 has a generally vertical member 50 that protrudes upward from a respective arm 21 and a generally horizontal member 52 that is attached to an upper end of the generally vertical member 50 and extends outwardly toward the outer periphery 22B of the two-tier canopy 10B.

As with the first canopy cover 14B, the second canopy cover 44 includes a plurality of sleeves 48. Each sleeve 48 forms a pocket that receives a peripheral end of the generally horizontal member 52 of a corresponding one of the hooks 46. In one embodiment, the canopy frame 12B' includes eight arms 21, with a hook 46 extending from every other arm 21 and the second canopy cover 44 includes four sleeves 48, which each receive a corresponding one of the hooks 46.

As shown in FIG. 6, the connecting plate 40 of the canopy frame 12B' includes a plurality of radially extending spokes 54. Each spoke 54 includes an opening for receiving a corresponding one of the arms 21. Also attached to the connecting plate 34 is the central post 42. As described above, the central post 42 extends through the central opening 27 of the first canopy cover 14B to support the second canopy cover 44.

Figure 7:
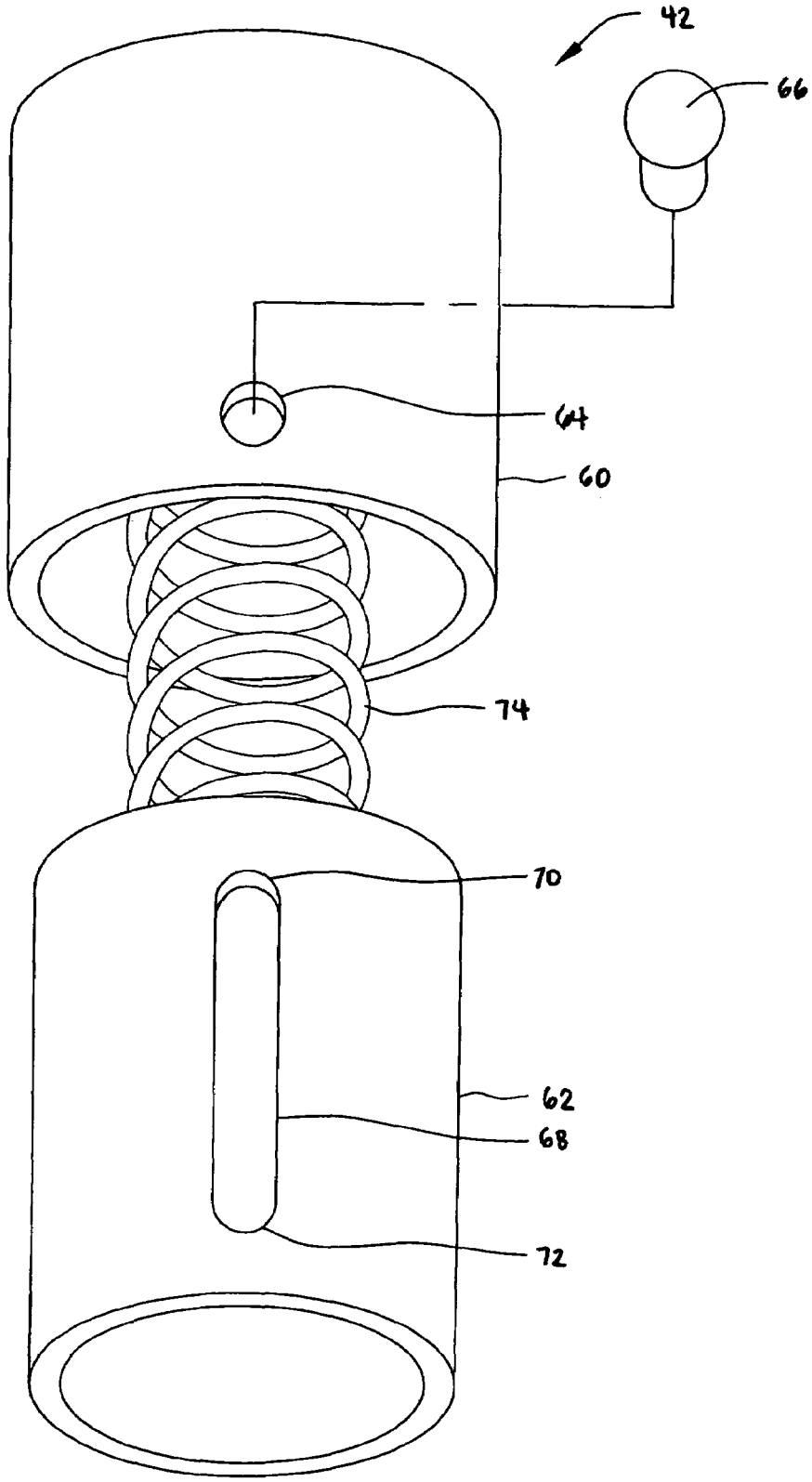
FIG. 7 is an exploded schematic view of a central post of the canopy frame of FIG. 4 for supporting a second covering of the two tier canopy system of FIG. 3.

In one embodiment, the central post 42 is upwardly biased to support the second canopy cover 44 in a taut manner. For example, as shown in FIG. 7, the central post 42 includes an upper sleeve 60 slidably connected and a lower sleeve 62, so that the upper sleeve 60 overlaps a varying portion of the lower sleeve 62 depending of the position of the upper sleeve 60 relative to the lower sleeve 62. As such the length of the central post 42 varies depending on the position of the upper sleeve 60 relative to the lower sleeve 62.

In the depicted embodiment of FIG. 7, the upper sleeve 60 includes an opening 64 for receiving a pin 66. The pin 66 also extends into a slot 68 in the lower sleeve 62. The slot 68 defines a maximum and minimum overlapping of the upper sleeve 60 relative to the lower sleeve 62, and therefore defines the maximum and minimum lengths of the central post 42. That is, when the pin 66 contacts an upper end 70 of the slot 68, the overlapping portion of the upper sleeve 60 relative to the lower sleeve 62 is minimized and the length of the central post 42 is maximized; and when the pin 66 contacts an lower end 72 of the slot 68, the overlapping portion of the upper sleeve 60 relative to the lower sleeve 62 is maximized and the length of the central post 42 is minimized.

The lower sleeve 62 may be integrally formed with or rigidly affixed to a top surface of the connecting plate 40 of the canopy frame 12B'. The central post 42 includes a biasing member 74, for example a spring such as a compression spring, for biasing the upper sleeve 60 away from the lower sleeve 62 and toward the second canopy cover 44. As such, the central post 42 biases the second canopy cover 44 upwardly. For example, in the exemplary embodiment of FIG. 7, a lower portion of the biasing member 74 contacts a lower surface of the lower sleeve 62 and an upper portion of the biasing member contacts an upper surface of the upper sleeve 60 to bias the upper and lower sleeves 60 and 62 away from each other.

The upward biasing of the central post 42 on the second canopy cover 44, causes the second canopy cover sleeves 48 to be pulled closely against the hooks 46 of the canopy frame 12B'. Thus causing the second canopy cover 44 to be tautly held to the canopy frame 12B'.

Although the canopy frame 12B' of FIG. 4 is described as being used in connection with a two-tier canopy system 10B as shown in FIG. 3, the canopy frame 12B' of FIG. 4 may also be used in connection with the one-tier canopy system 10 as shown in FIG. 1. In such a case, the hooks 46 are not necessary.

Figure 8:
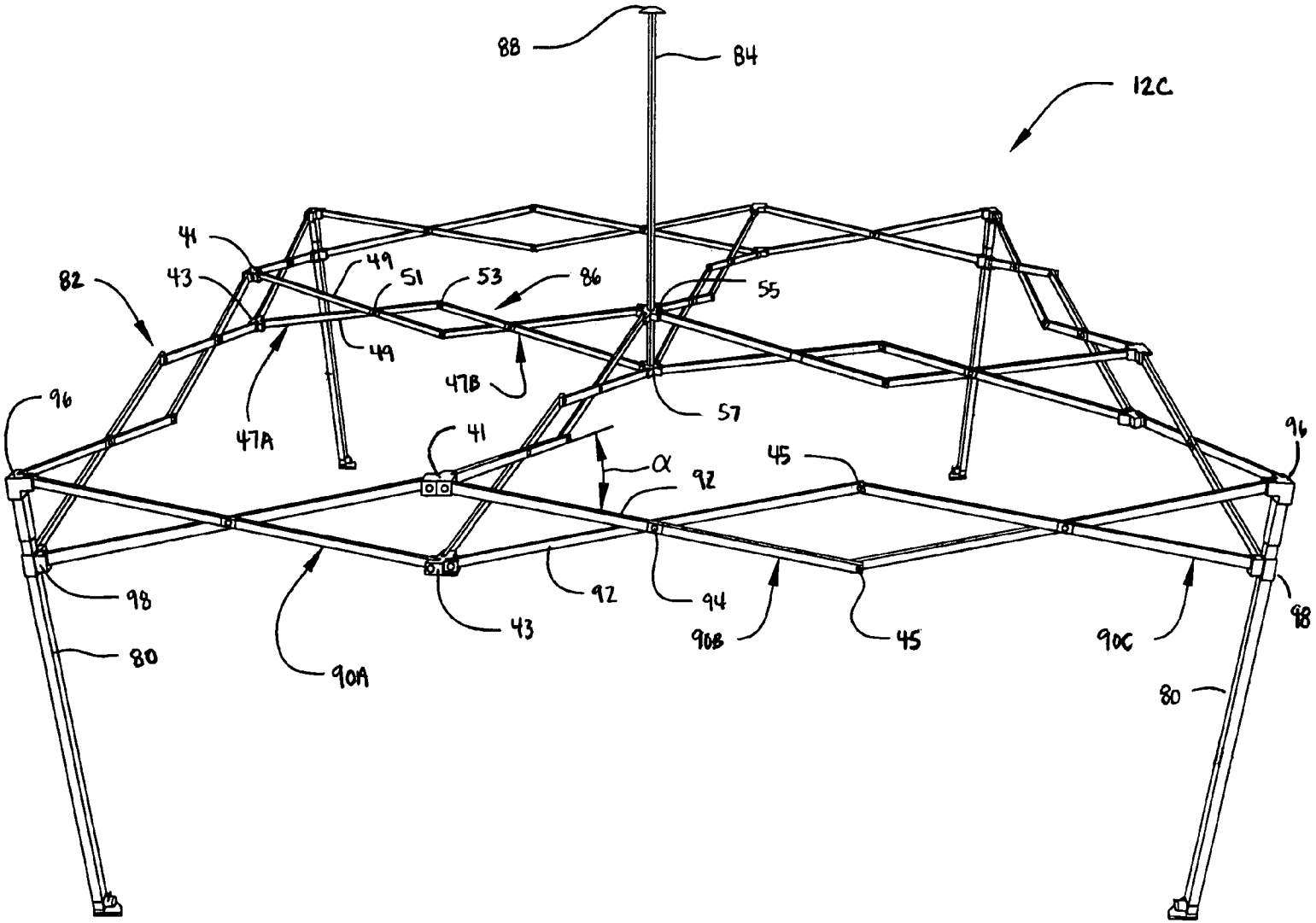
FIG. 8 is a perspective view of a collapsible canopy frame according to an exemplary embodiment of the present invention.

In other embodiments, either the one-tier canopy system 10 or the two-tier canopy system 10B may include a collapsible canopy frame. FIG. 8 shows an exemplary collapsible canopy frame 12C having four side poles 80 arranged in a generally rectangular or square configuration. In other embodiments, however, the collapsible canopy frame 12C may include any appropriate number of side poles 80 arranged in any appropriate configuration, such as pentagonal, hexagonal or octagonal, among other appropriate configurations.

Each pair of adjacent side poles 80 is connected to and supported by an edge scissor assembly 82. Each edge scissor assembly 82 is coupled to and supports a center pole 84 through an inner scissor assembly 86. The center pole 84 is disposed at or near the center of the collapsible canopy frame 12C and has a head member 88, such as a convex shaped head member, which supports a canopy cover, such as either of the canopy covers 14 or 14B described above (although the canopy cover has been omitted from the collapsible canopy frame 12C of FIG. 8 for clarity.)

In the embodiment of FIG. 8, each edge scissor assembly 82 includes three scissor units 90A, 90B and 90C (sometimes referred to hereinafter generically as scissor units 90.) Each scissor unit 90 includes two hingedly connected truss bars 92 that move about a pivot 94 in a scissor-like manner between an expanded position and a retracted position.

As shown in FIG. 8, the scissor units 90 within each edge scissor assembly 82 are pivotally connected to each other in series. For example, in the depicted embodiment showing three scissor units 90 per edge scissor assembly 82, each edge scissor assembly 82 includes: a first outer scissor unit 90A, an inner scissor unit 90B, and a second outer scissor unit 90C. As shown, the first outer scissor unit 90A is pivotally connected at one end to upper and lower side pole connectors 96 and 98 of a corresponding one of the side poles 80, and pivotally connected at an opposite end to upper and lower scissor unit connectors 41 and 43. The inner scissor unit 90B is pivotally connected at one end to the upper and lower scissor unit connectors 41 and 43, and pivotally connected at an opposite end through pins 45 to the second outer scissor unit 90C. The second outer scissor unit 90C is pivotally connected at one end to the upper and lower side pole connectors 96 and 98 of a corresponding one of the side poles 80, and pivotally connected at an opposite end to the inner scissor unit 90B through the pins 45. In this embodiment each upper side pole connector 96 is non-movably mounted to a corresponding one of the side poles 80; and each lower side pole connector 98 is slidably mounted to a corresponding one of the side poles 80.

In the exemplary embodiment of FIG. 8, each inner scissor assembly 86 includes two scissor units 47A and 47B (sometimes referred to hereinafter generically as scissor units 47.) Each scissor unit 47 includes two hingedly connected truss bars 49 that move about a pivot 51 in a scissor-like manner between an expanded position and a retracted position.

As shown in FIG. 8, the scissor units 47 within each inner scissor assembly 86 are pivotally connected to each other in series. For example, in the depicted embodiment showing two scissor units 47 per inner scissor assembly 86, each inner scissor assembly 86 includes an outer scissor unit 47A pivotally connected at one end to upper and lower scissor unit connectors 41 and 43, and pivotally connected at an opposite end through pins 53 to an inner scissor unit 47B, which in turn is pivotally connected to upper and lower center pole connectors 55 and 57. In this embodiment, the lower center pole connectors 57 is non-movably mounted to a bottom end of the center pole 84; and the upper center pole connectors 55 is slidably mounted to the center pole 84.

When the collapsible canopy frame 12C is configured as described above, the collapsible canopy frame 12C is moveable between an expanded position (forming a stable portable structure as shown in FIG. 8), and a retracted position (forming a compacted structure for ease of transport, not shown.)

In the embodiment of FIG. 8, since each edge scissor assembly 82 has three scissor units 90, and the inner scissor assembly 86 is connected to the ends of the first outer scissor unit 90A and the inner scissor unit 90B, the inner scissor assembly 86 forms an acute angle $\alpha$ (as shown in FIG. 8) when connected between its corresponding edge scissor assembly 82 and the center pole 84.

Figure 9:
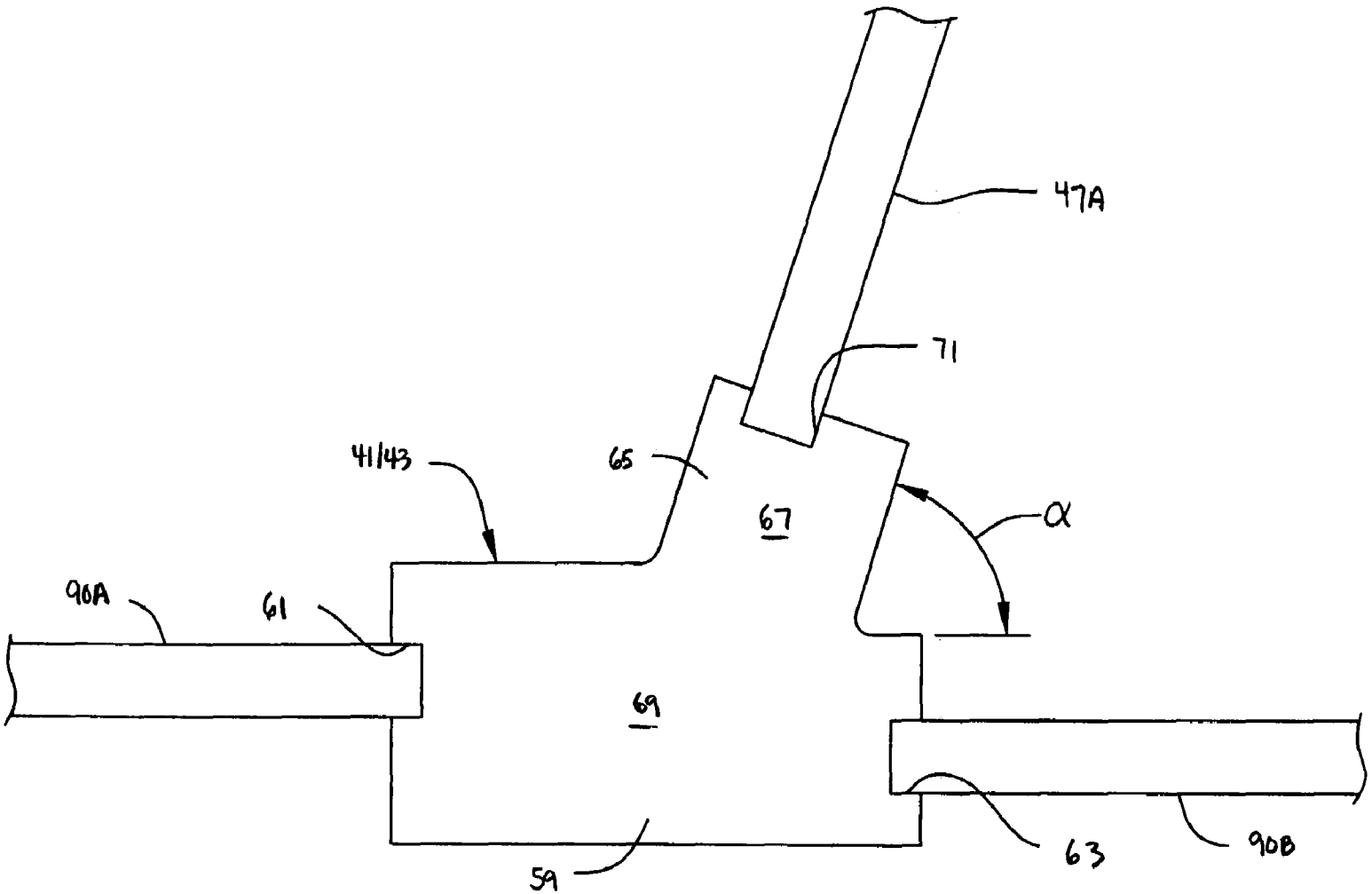
FIG. 9 is a top view of a scissor unit connecter for use with the collapsible canopy frame of FIG. 8.

The upper and lower scissor unit connectors 41 and 43 are mirror images or each other as so only one connector, which may represent either the upper or the lower scissor unit connector 41 and 43 is shown in FIG. 9. For reference, the connector of FIG. 9 is referred to as the upper scissor unit connector 41. As shown, the upper scissor unit connector 41 has a base 59 having at one end a slot 61 for receiving an end of the first outer scissor unit 90A, and having at an opposite end a slot 63 for receiving an end of the inner scissor unit 90B. Connected to the base 59 of the upper scissor unit connector 41 is an arm 65 that extends therefrom at approximately the same acute angle $\alpha$ at which the inner scissor assembly 86 is connected between the edge scissor assembly 82 and the center pole 84. It should be noted that an upper surface 67 of the extending arm 65 is co-planer with an upper surface 69 of its corresponding base 59. The arm 65 includes a slot 71 for receiving the outer scissor unit 47A.

The angled arm 65 of the upper scissor unit connector 41 allows each inner scissor assembly 86 to be connected to its corresponding edge scissor assembly 82 at a position offset from a midpoint of the edge scissor assembly 82. Stated another way, the angled arm 65 of the upper scissor unit connector 41 allows each inner scissor assembly 86 to be connected to its corresponding edge scissor assembly 82 at a position offset from a midpoint between its corresponding adjacent side poles 80. Thus, each edge scissor assembly 82 can include more than two scissor units 90, such as the three scissor units 90A-C as shown in FIG. 8.

In the depicted embodiment, each inner scissor assembly 86 is connected to its corresponding edge scissor assembly 82 at a position of approximately one third of the total length of the edge scissor assembly 82, or approximately at a position of approximately one third of the total distance between the corresponding adjacent side poles 80.

Although the above described exemplary embodiments discuss each edge scissor assembly 82 as including three scissor units 90, each edge scissor assembly 82 may include any suitable number of scissor units 90 and each inner scissor assembly 86 may be attached to the series of scissor units 90 within a corresponding edge scissor assembly 82 at the ends of any two adjacent scissor units 90. However, it should be noted that the acute angle α that the extending arm 65 makes with the base 59 of the upper scissor unit connector 41 is dependent on which scissor units 90 that the inner scissor assembly 86 is attached to in the series of scissor units 90 within each edge scissor assembly 82. For example, the angle α of the angled arm 65 of the upper scissor unit connector 41 is greater when the inner scissor assembly 86 is connected at the ends of the first and second scissor units 90 in a series of five scissor units (not shown) than when the inner scissor assembly 86 is connected at the ends of the second and third scissor units 90 in a series of five scissor units (not shown.)

In one embodiment, each side pole 80 is telescoping, thereby allowing the height of each side pole 80 to be independently adjusted. The telescoping side pole includes an upper pole section and a lower pole section that are slideable with respect to one another. The telescoping side pole in other embodiments may have three or more pole sections.

Figure 10:
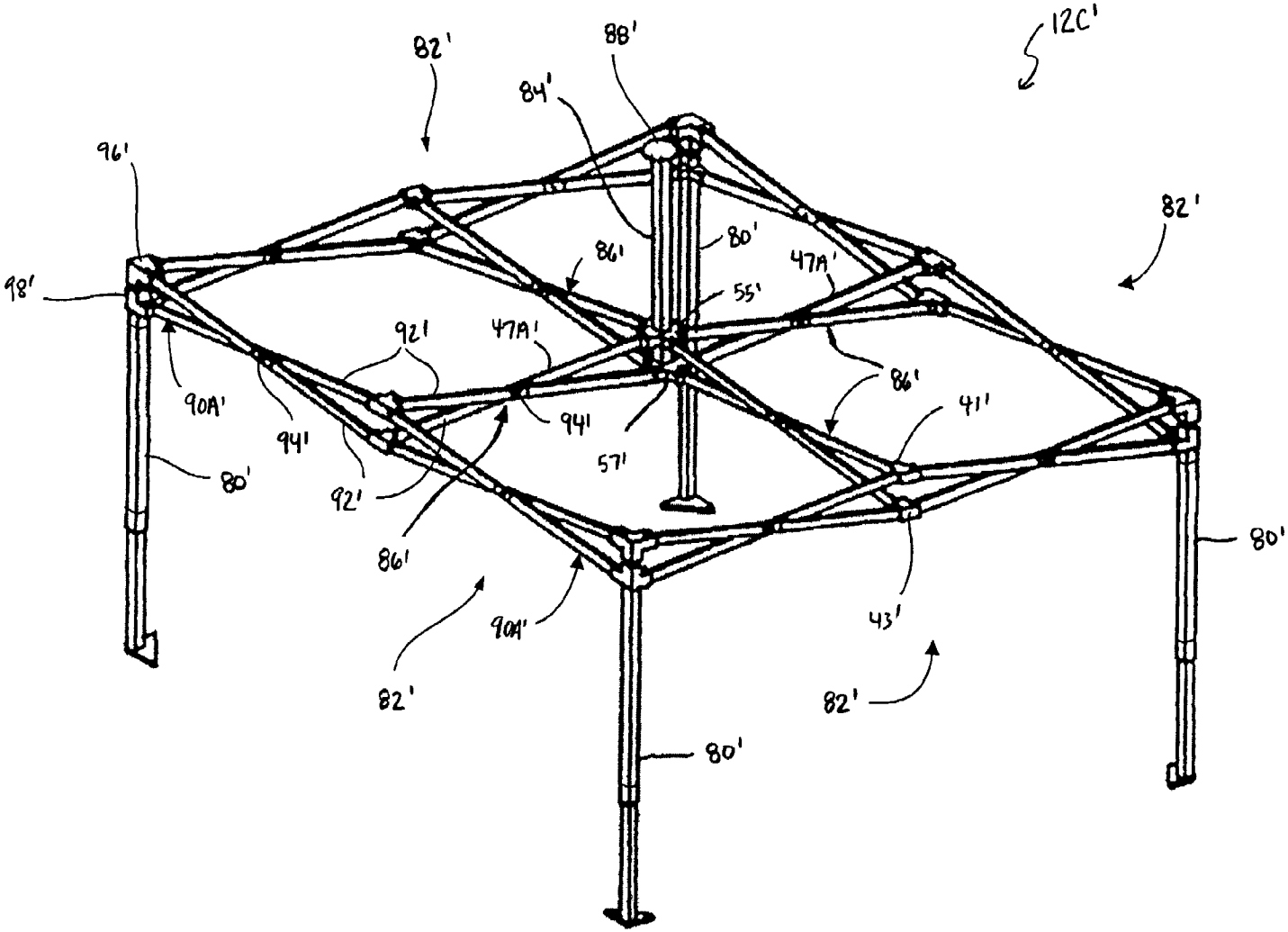
FIG. 10 is a perspective view of a collapsible canopy frame according to another exemplary embodiment of the present invention.

FIG. 10 shows another exemplary collapsible canopy frame 12C'. As with the collapsible canopy frame 12C described above with respect to FIG. 8, the collapsible canopy frame 12C' includes side poles 80' connected to and supported by an edge scissor assembly 82'. Each edge scissor assembly 82' is coupled to and supports a center pole 84' through an inner scissor assembly 86'. The center pole 84' is disposed at or near the center of the collapsible canopy frame 12C' and has a head member 88', such as a convex shaped head member, which supports a canopy cover, such as either of the canopy covers 14 or 14B described above (although the canopy cover has been omitted from the collapsible canopy frame 12C' of FIG. 10 for clarity.) In the embodiment of FIG. 10, each edge scissor assembly 82' includes two scissor units 90A' each having two hingedly connected truss bars 92' that move about a pivot 94' in a scissor-like manner between an expanded position and a retracted position.

As shown in FIG. 10, each scissor unit 90A' is pivotally connected at one end to upper and lower side pole connectors 96' and 98' of a corresponding one of the side poles 80, and pivotally connected at an opposite end to upper and lower scissor unit connectors 41' and 43'. In this embodiment each upper side pole connector 96' is non-movably mounted to a corresponding one of the side poles 80'; and each lower side pole connector 98' is slidably mounted to a corresponding one of the side poles 80'.

In the exemplary embodiment of FIG. 10, each inner scissor assembly 86' includes a single scissor units 47A' having two hingedly connected truss bars 92' that move about a pivot 94' in a scissor-like manner between an expanded position and a retracted position. As is also shown, each scissor unit 47A' is pivotally connected at one end to the upper and lower scissor unit connectors 41' and 43', and pivotally connected at an opposite end to upper and lower center pole connectors 55' and 57'. In this embodiment, the lower center pole connector 57 is non-movably mounted to a bottom end of the center pole 84'; and the upper center pole connector 55 is slidably mounted to the center pole 84'.

When the collapsible canopy frame 12C' is configured as described above, the collapsible canopy frame 12C' is moveable between an expanded position (forming a stable portable structure as shown in FIG. 10), and a retracted position (forming a compacted structure for ease of transport, not shown.)

In the embodiment of FIG. 10, each inner scissor assembly 86' extends perpendicularly from its corresponding edge scissor assembly 82'to connect to the center pole 84'. Therefore, in this embodiment, the upper and lower scissor unit connectors 41' and 43' are T-shaped, having opposing arms that receive scissor units 90A' from the edge scissor assembly 82'and a perpendicular arm that receives the scissor unit 47A' from the inner scissor assembly 86'.

Although the collapsible canopy frame of FIG. 10 is shown having edge scissor assemblies with two scissor units 90A' each; and inner scissor assemblies 86' with one scissor unit 47A' each, in other embodiments the edge scissor assemblies 82' and the inner scissor assemblies 86' may have any appropriate number of scissor units 90A' and 47A'.

The preceding description has been presented with references to certain exemplary embodiments of the invention. Persons skilled in the art and technology to which this invention pertains will appreciate that alterations and changes in the described structures and methods of operation can be practiced without meaningfully departing from the principle, spirit and scope of this invention. Accordingly, the foregoing description should not be read as pertaining only to the precise structures described and shown in the accompanying drawings. Instead, the scope of the application is to be defined by the appended claims, and equivalents thereof.

What is claimed is:

1. A canopy system comprising:

a canopy frame adapted to be placed standing on ground, the canopy frame comprising a plurality of peripheral support members at an outer periphery of the canopy frame and a plurality of side poles supporting the plurality of peripheral support members; and a canopy cover supported by the canopy frame and comprising:

an inner solid portion, an outer solid portion, and a meshed portion disposed between the inner and outer solid portions and disposed proximately to the plurality of peripheral support members at the outer periphery of the canopy frame the meshed portion encircling an outer periphery of the inner solid portion, and the outer solid portion encircling an outer periphery of the meshed portion, wherein the canopy frame is configured such that the canopy cover has a downward slope from a peak portion near a center of the canopy cover to edges of the canopy cover, so as to make a fluid on the canopy cover to flow downward toward the edges of the canopy cover, such that the fluid passes through the meshed portion.

2. The canopy system of claim 1, wherein a majority of the canopy cover is defined by the inner solid portion, with the meshed portion and the outer solid portion each defining relatively small outer strips of the canopy cover.

3. The canopy system of claim 1, wherein the meshed portion is in the form of a screen.

4. The canopy system of claim 1, wherein the meshed portion is formed by a porous material.

5. The canopy system of claim 1, wherein the inner and outer solid portions are adapted to substantially prevent a passage of the fluid therethrough and the meshed portion is adapted to permit a passage of the fluid therethrough.

6. The canopy system of claim 1, wherein the canopy system is a two-tier canopy system.

7. The canopy system of claim 6, wherein the canopy cover comprises a central opening defined by the peak portion, through which a central post of the canopy frame extends, and further comprising a second canopy cover supported by the central post, wherein the second canopy cover is substantially solid.

8. The canopy system of claim 1, wherein the canopy frame is a collapsible canopy frame.

9. The canopy system of claim 8, wherein the plurality of peripheral support members comprises a plurality of edge scissor assemblies, wherein the plurality of side poles is arranged in a configuration, wherein each of the plurality of edge scissor assemblies is coupled between adjacent ones of the plurality of side poles, and wherein the collapsible canopy frame further comprises:

a center pole disposed within the configuration of the side poles; and at least one inner scissor assembly comprising a first end and a second end, wherein the first end is coupled to a corresponding one of the edge scissor assemblies, and wherein the second end is coupled to the center pole.

10. A canopy system comprising:

a canopy frame comprising a plurality of peripheral support members at an outer periphery of the canopy frame and a plurality of side poles supporting the plurality of peripheral support members; and a canopy cover supported by the canopy frame and comprising:

an inner solid portion, a meshed portion, which encircles the inner solid portion, an outer solid portion, which encircles the meshed portion and defines edges of the canopy cover, wherein the meshed portion is disposed proximately to the plurality of peripheral support members, wherein the canopy frame is configured such that the canopy cover has a downward slope from a peak portion near a center of the canopy cover to the edges of the canopy cover, so as to make a fluid on the canopy cover to flow downward toward the edges, wherein the inner and outer solid portions are adapted to substantially prevent a passage of the fluid therethrough and the meshed portion is adapted to permit a passage of the fluid therethrough, such that the fluid passes through the meshed portion, and wherein a majority of the canopy cover is defined by the inner solid portion, with the meshed portion and the outer solid portion each defining relatively small outer strips of the canopy cover.

11. The canopy system of claim 10, wherein the meshed portion is in the form of a screen.

12. The canopy system of claim 10, wherein the meshed portion is formed by a porous material.

13. The canopy system of claim 10, wherein the canopy system is a two-tier canopy system.

14. The canopy system of claim 13, wherein the canopy cover comprises a central opening defined by the peak portion, through which a central post of the canopy frame extends, and further comprising a second canopy cover supported by the central post, wherein the second canopy cover is substantially solid.

15. The canopy system of claim 10, wherein the canopy frame is a collapsible canopy frame.

16. The canopy system of claim 15, wherein the plurality of peripheral support members comprises a plurality of edge scissor assemblies, wherein the plurality of side poles is arranged in a configuration, wherein each of the plurality of edge scissor assemblies is coupled between adjacent ones of the plurality of side poles, and wherein the collapsible canopy frame further comprises:

a center pole disposed within the configuration of the side poles; and at least one inner scissor assembly comprising a first end and a second end, wherein the first end is coupled to a corresponding one of the edge scissor assemblies, and wherein the second end is coupled to the center pole.

17. A canopy comprising:

a canopy frame comprising a plurality of peripheral support members at an outer periphery of the canopy frame and a plurality of side poles supporting the plurality of peripheral support members;

a lower canopy cover supported by the canopy frame and comprising:

an inner solid portion having an opening defined at its center;

an outer solid portion; and a meshed portion disposed between the inner and outer solid portions and disposed proximately to the plurality of peripheral support members at the outer periphery of the canopy frame the meshed portion encircling an outer periphery of the inner solid portion, and the outer solid portion encircling an outer periphery of the meshed portion, and an upper canopy cover located above the opening, wherein the upper canopy cover is spaced apart from the lower canopy cover, wherein the canopy frame is configured such that the lower canopy cover has a downward slope from a peak portion surrounding the opening to edges of the lower canopy cover, so as to make a fluid on the lower canopy cover to flow downward toward the edges of the lower canopy cover.

18. The canopy of claim 17, wherein a majority of the lower canopy cover is defined by the inner solid portion, with the meshed portion and the outer solid portion each defining relatively small outer strips of the lower canopy cover.

19. The canopy system of claim 17, wherein the inner and outer solid portions are adapted to substantially prevent a passage of the fluid therethrough and the meshed portion is adapted to permit a passage of the fluid therethrough.

* * * * *